US006511285B2

(12) United States Patent
Dodd

(10) Patent No.: US 6,511,285 B2
(45) Date of Patent: Jan. 28, 2003

(54) TANDEM GUIDE VANES

(75) Inventor: Alec G Dodd, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/062,511

(22) Filed: Feb. 5, 2002

(65) Prior Publication Data

US 2002/0197157 A1 Dec. 26, 2002

(30) Foreign Application Priority Data

Jun. 20, 2001 (GB) ..... 0104497

(51) Int. Cl.[7] ..... F01D 9/04; F01D 11/00

(52) U.S. Cl. ..... 415/147; 415/146; 415/148; 415/159; 415/171.1; 415/174.2; 415/193; 415/194

(58) Field of Search ..... 415/110, 146, 415/147, 148, 159, 170.1, 171.1, 174.2, 193, 194, 167, 209.1

(56) References Cited

U.S. PATENT DOCUMENTS 3,112,866 A * 12/1963 Fortescue ..... 415/193
5,383,763 A * 1/1995 Henkelmann ..... 415/159
5,984,631 A * 11/1999 Tolgos ..... 415/194
2001/0010798 A1 * 8/2001 Dailey et al. ..... 415/159

FOREIGN PATENT DOCUMENTS

| | | | | |
|---|---|---|---|---|
| CA | 624185 A | * | 7/1961 | ..... 415/159 |
| GB | 272459 P | | 9/1927 | |
| SU | 152468 A | * | 1/1963 | ..... 415/159 |

* cited by examiner

*Primary Examiner*—Christopher Verdier
(74) *Attorney, Agent, or Firm*—W. Warren Taltavull; Manelli Denison & Selter PLLC

(57) ABSTRACT

Two stages of relatively rotatable guide vanes (22,24) are arranged in tandem. Shroud portions (42,46) on the vanes overlap in loose engagement, until an associated gas turbine engine starts operating. Gas loads then act on the downstream vane stage (24) and move it in a downstream direction until the opposing flanks of radially opposing lands (44,48) on respective shrouds (42,46) engage, whereupon, gas leakage via the overlap onto the turbine casing (40) is at least substantially reduced.

6 Claims, 2 Drawing Sheets

TANDEM GUIDE VANES

The present invention relates to gas turbine engine guide vanes. In particular, the present invention relates to gas turbine engine guide vanes that in use, are arranged in tandem, i.e. two stages of guide vanes are arranged adjacent each other in axially spaced relationship, in a gas turbine engine turbine system, there being no rotary turbine stage between them. The downstream stage of guide vanes is rotatable about the turbine system axis, relative to the adjacent upstream stage. Just such an arrangement, with benefits accrued thereby, is described, illustrated and claimed, in UK patent application 0002257.4 filed by the applicant for a patent for the present invention.

The present invention seeks to provide an improved arrangement of tandem mounted guide vanes.

According to the present invention, an arrangement of relatively rotatable stages of guide vanes mounted in tandem for use in a turbine system comprises a first stage of guide vanes having respective outer end shrouds, each of which includes at least one radially outwardly extending land portion on its outer surface, and a second stage of guide vanes having respective outer end shrouds, each of which includes at least one radially inwardly extending land portion on its inner surface, so that on assembly of said first and second stages of guide vanes in axial juxtaposition in a turbine system, the at least one inwardly extending land on each second stage guide vane lies upstream of an adjacent outwardly extending land on a respective first stage guide vane, so that on said guide vanes being subjected to gas loads during operation in a gas turbine engine, the second stage of guide vanes moves in a downstream direction and causes said lands to abut each other and thus provide a gas seal.

The invention will now be described, by way of example and with reference to the accompanying drawings in which.

Figure 1:
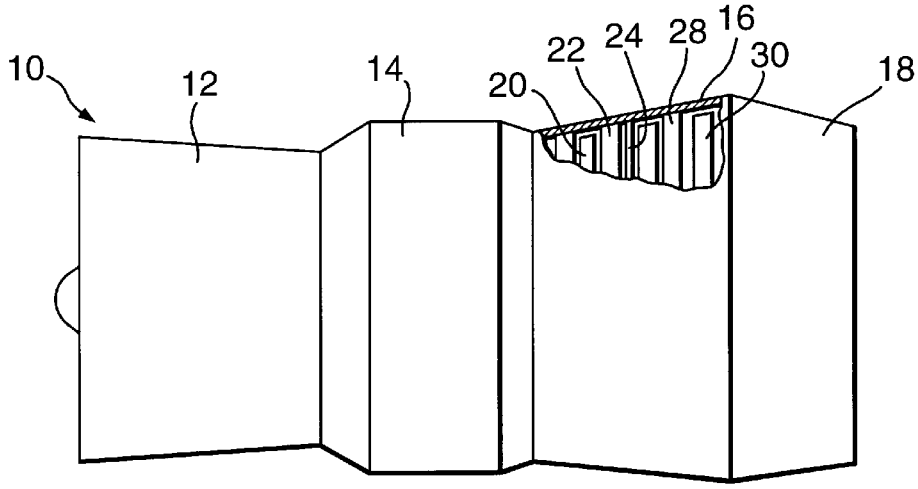
FIG. 1 is a diagrammatic view of a gas turbine engine incorporating in its turbine system, first and second guide vane stages in accordance with the present invention.

Referring to FIG. 1, a gas turbine engine 10 has a compressor 12, a combustion system 14, a turbine system 16, and an exhaust pipe 18. The turbine system 16 has a first rotary turbine stage 20, followed by a first stage of fixed guide vanes 22, which in turn are followed by a second, partially rotatable stage of guide vanes 24. Another rotary turbine stage 26 follows the stages of vanes 24, the turbine system 16 being completed by a further fixed stage of guide vanes 28, and a final rotary turbine stage 30.

Figure 2:
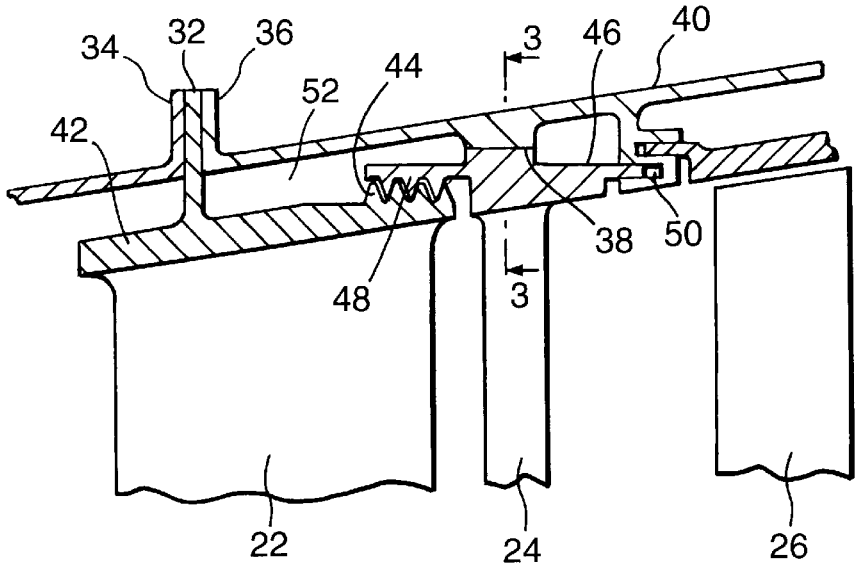
FIG. 2 is an enlarged part view of the outer ends of the first and second guide vane stages of FIG. 1.

Referring to FIG. 2 first guide vane stage 22 is positionally fixed via a flange 32, which is trapped between flanges 34 and 36 on respective turbine casing pats. Second guide vane stage 24 is mounted in a sliding relationship in a bore 38 formed on the inner surface of turbine casing part 40.

Each guide vane 22 has a shroud 42 formed on its radially outer end, with respect to the engine axis. The outer surface of each shroud 42 has a screw thread portion 44 formed thereon, at its downstream end, with respect to the flow of gases through the engine 10 during operation. Each guide vane 24 also has a shroud 46 on its radially outer end, the upstream end of which has a screw thread portion 48 formed on its inner surface. Thus, assembly of the two stages of guide vanes 22 and 24 in tandem, is enabled, firstly by sliding vane stage 24 through bore 38 until the downstream end of shroud 46 enters a bird mouth slot 50 formed in an annular ring within casing part 40, and thereafter, screwing the stage of vanes 22 to vanes 24 until its flange 32 abuts flange 36 of turbine casing part 40. The flange 34 of the next upstream turbine casing part is then fitted against flange 32, and the three flanges 34, 32 and 36 bolted together.

The flanks of the screw threads 44 and 48 provide respective near radially outwardly and inwardly extending lands which, during operation of engine 10, engage each other and thereby form a seal against gas leakage from the flow duct defined in part by the shrouds 42 and 46, into the space 52 defined by the shrouds 42 and 46, and the turbine casing part 40. The sealing function is enhanced by virtue of gas loads which act on the stage of guide vanes 22, and thus cause the flanks on one side of screw thread 48 to press against opposing flanks on screw thread 44.

Figure 3:
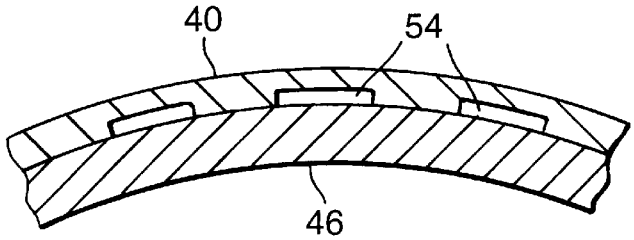
FIG. 3 is a view on line 3—3 of FIG. 2.

Referring now to FIG. 3 the turbine casing part 40 has a number of equally angularly spaced grooves 54 formed therein, so as to reduce the surface area contact between itself and shroud 46. Friction is thus reduced, enabling easier rotation of guide vanes 24, relative to guide vanes 22. The act of rotation can be effected by any suitable known means, including those shown and described in UK patent application 0002257.4.

Figure 4:
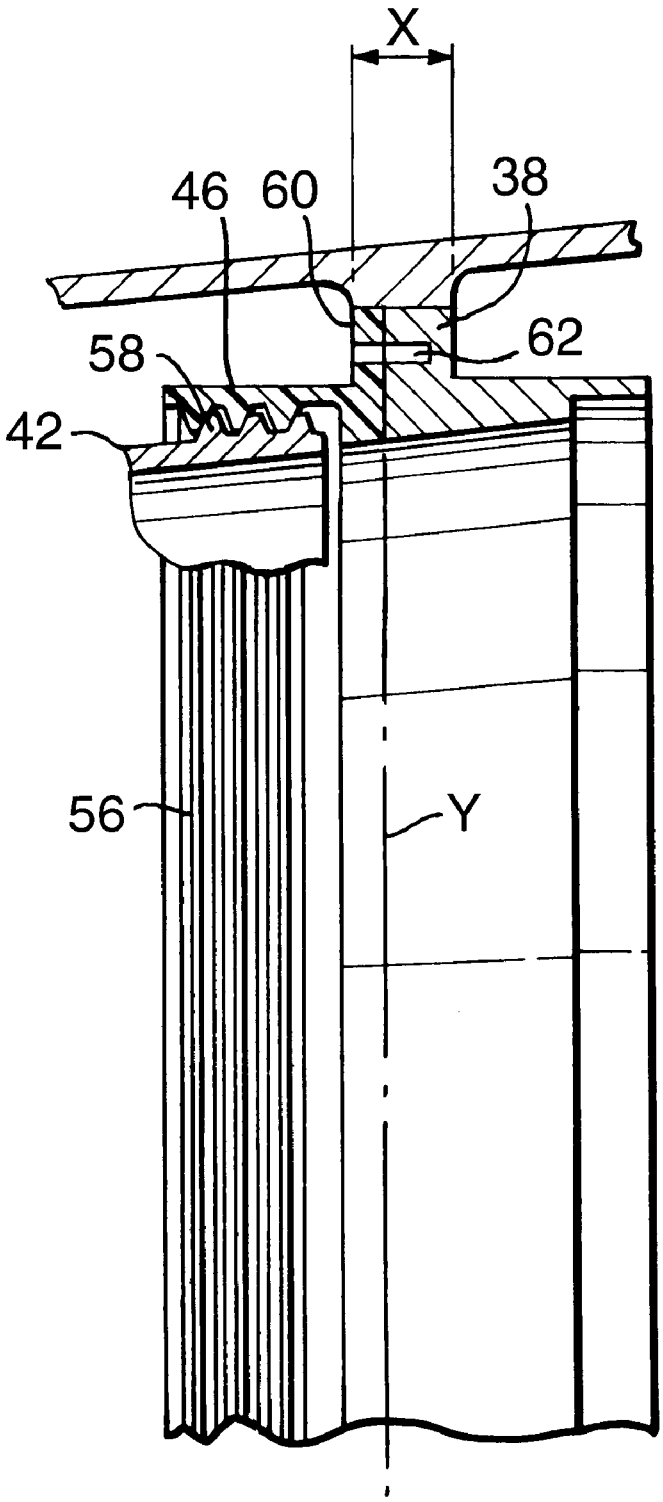
FIG. 4 is a cross sectional part view of an alternative example of the present invention.

Referring now to FIG. 4 in this alternative example of the present invention, simple annular lands 56 are utilised on respective shrouds 42 and 46 for the provision of sealing flanks. However, the arrangement generates complication in the fitting of the lands together. Indeed, the shroud 46, or at least a part of it, must be split at diametrically opposite places, so as to enable fitting of the lands 56 on shroud 46 into the grooves defined by the lands 58 on shroud 42, in two opposing halves. Concentricity of the assembly is important, and may be achieved by manufacturing shroud 46 in the following manner:

a) Make shroud 46, including lands 56, in one piece, with the intention of eventually separating the land portion and the flange 60 therefrom. Thus dimension X must be such as to allow metal removal to achieve separation.

b) Drill at least two spaced apart location dowel holes 62 only one of which is shown, into the shroud 46.

c) Drill a required number of tapping holes (not shown) in the shroud 46, in the same side thereof as dowel holes 62, but do not tap them, i.e. form internal screw threads.

d) Countersink the tapping holes to a depth slightly deeper than the intended thickness of flange 60.

e) Part off the landed portion and flange 60 from the remainder of shroud 46, along line Y.

f) Tap the tapping holes (not shown).

g) Split landed portion and associated flange 60 into two halves.

h) Fit the two halves around shroud 42 with opposing lands and grooves engaging. Abut flange 60 against the drilled face of shroud 46. Align dowel holes and fit dowels (not shown), to ensure concentricity therewith. Fit set screws through flange 60, into tapped holes in shroud 46 to complete assembly.

The assembly is inserted inside turbine casing portion 40, until the downstream edge of shroud 46 locates within bird mouth slot 50 (FIG. 2), the outer surface of shroud 46 nests within bore 38, and flange 32 (FIG. 2) abuts flange 36. The next upstream turbine casing portion is then placed in abutment with the other side of flange 32, and the three flanges 34, 32 and 36 are bolted together by nuts and bolts (not shown).

Both of the examples of the present invention described and illustrated in FIGS. 1 to 2 and 4 respectively are provided with sloping lands. A benefit derived therefrom is that a larger sealing surface area is obtained, than would be possible if a square profile was adopted. However, truly radial lands (not shown) could be used, and would improve sealing of the shroud junctures relative to the sealing efficiency of the prior art referred to herein. Further whilst the examples described and illustrated in this specification each have a plurality of lands, this should not be regarded as limitive. The number of lands utilised with be dictated by the magnitude of the gas leakage, and may vary from one to more than one.

I claim:

1. An arrangement of relatively rotatable guide vanes mountable in tandem for use in a turbine system, comprising a first stage of guide vanes having respective outer end shrouds, each of which includes at least one radially outwardly extending land portion on its outer surface, and a second stage of guide vanes having respective outer end shrouds, each of which includes at least one radially inwardly extending land portion on its inner surface, so that on assembly of said first and second stages of guide vanes in axial juxtaposition in the turbine system, the at least one inwardly extending land on each second stage guide vane lies upstream of an adjacent outwardly extending land on a respective first stage guide vane, so that on said guide vanes, in use, being subjected to gas loads during operation of a gas turbine engine containing said turbine system, the second stage guide vanes move in a downstream direction and cause said lands to abut each other and thus effect a gas seal.

2. An arrangement of guide vanes as claimed in claim 1 wherein both the inwardly and outwardly extending lands are helically formed about their respective stages of guide vanes, said helical forms having a common pitch to enable joining said stages by a screwing action.

3. An arrangement of guide vanes as claimed in claim 1 wherein both the inwardly and outwardly extending lands are annular and said guide vane stages are joined by positioning the inwardly extending lands with their downstream faces adjacent the upstream faces of said outwardly extending lands.

4. An arrangement of guide vanes as claimed in claim 1 wherein said lands have converging flanks.

5. An arrangement of guide vanes as claimed in claim 1 wherein said lands have parallel flanks.

6. A gas turbine engine including an arrangement of guide vanes as claimed in claim 1.

* * * * *